US006079300A

United States Patent [19]

Hu

[11] Patent Number: 6,079,300

[45] Date of Patent: Jun. 27, 2000

[54] OPTICAL CLEARANCE DEVICES FOR ADJUSTABLE WRENCHES

[76] Inventor: Bobby Hu, P.O. Box 63-247, Taichung, Taiwan

[21] Appl. No.: 09/192,341

[22] Filed: Nov. 13, 1998

[51] Int. Cl.[7] ..... B25B 13/14

[52] U.S. Cl. ..... 81/165; 81/133

[58] Field of Search ..... 81/133–140, 142–145, 81/165, 170–172

[56] References Cited

U.S. PATENT DOCUMENTS

| | | | |
|---|---|---|---|
| 1,512,846 | 10/1924 | Gumprecht | 81/165 |
| 2,483,917 | 10/1949 | Maselter | 81/165 |
| 2,648,243 | 8/1953 | Chappel | 81/165 |
| 2,755,693 | 7/1956 | Hund | 81/165 |
| 2,780,124 | 2/1957 | Lyons | 81/165 |
| 2,808,751 | 10/1957 | Fercana | 81/165 |
| 2,913,942 | 11/1959 | Rozmus | 81/165 |
| 4,094,215 | 6/1978 | Hudson | 81/133 X |
| 5,154,103 | 10/1992 | Lewis, Jr. | 81/165 |
| 5,209,144 | 5/1993 | Lu Guoji | 81/165 |

*Primary Examiner*—D.S. Meislin
*Attorney, Agent, or Firm*—Charles E Baxley, Esq.

[57] ABSTRACT

An adjustable wrench includes a handle, a head connected to the handle and including a fixed jaw formed thereon and a movable jaw mounted thereon, an adjusting screw rotatably mounted in a web area between the handle and the head for moving the movable jaw relative to the fixed jaw, and a clearance retaining device having an end releasably engaged with the adjusting screw. The clearance retaining device is normally in a first free position not engaged with the adjusting screw. When the clearance retaining device is moved to a second retained position for fine adjustment, the adjusting screw is rotated through a pre-determined angle such that the movable jaw is slightly moved away from the fixed jaw for a pre-determined distance. The clearance retaining device is retained in the second retained position by the adjusting screw after such fine adjustment.

12 Claims, 13 Drawing Sheets

OPTICAL CLEARANCE DEVICES FOR ADJUSTABLE WRENCHES

BACKGROUND OF THE INVENTION

1. Field of the Invention

The present invention relates to clearance retaining devices that may assure an optimal clearance between a movable jaw of an adjustable wrench and an article held between the movable jaw and the fixed jaw.

2. Description of the Related Art

FIG. 23 illustrates a typical adjustable wrench that has a fixed jaw 12' and a movable jaw 13'. When driving a nut (not shown), the adjusting screw 14' is rotated until the space between the jaws 12' and 13' is capable of receiving the nut. Next, the movable jaw 13' is moved toward the fixed jaw 12' to tightly clamp the nut. Typically, an end wall of the movable jaw 13' generally has an angle $\alpha$ (about 0.5°) to a plane that is parallel to an inner wall of the fixed jaw 12'. Nevertheless, in order to allow easy disengagement of the adjustable wrench and the nut, the user generally has to proceed with minor adjustment by means of rotating the adjusting screw 14' again to move the movable jaw 13' slightly away from the fixed jaw 12' to thereby obtain an optimal clearance. However, such minor adjustment is difficult to achieve. The faces or edges of the nut will be damaged if the minor adjustment goes too far. To the contrary, it is difficult to disengage the adjustable wrench from the nut if the minor adjustment is not enough. In addition, the movable jaw 13' and the adjusting screw 14', even if the minor adjustment is achieved, will be moved upon repeated operation of the adjustable wrench on the nut. Furthermore, the adjusting screw 14' might be inadvertently impinged by the user's fingers or any articles and thus causes a change in the clearance. As a result, there is a high risk of damage to the nut. Use of the adjustable wrenches is even prohibited in certain cases.

It is therefore a long and unfulfilled need in the adjustable wrench with a clearance retaining device to reliably retain the adjustable wrench in an optimal clearance.

SUMMARY OF THE INVENTION

It is a primary object of the present invention to provide an adjustable wrench with a retaining device to assure an optimal clearance between the movable jaw and the nut.

An adjustable wrench in accordance with the present invention comprises:

a handle;

a head connected to the handle and including a fixed jaw formed thereon and a movable jaw mounted thereon;

an adjusting screw rotatably mounted in a web area between the handle and the head for moving the movable jaw relative to the fixed jaw upon rotational movement of the adjusting screw; and a clearance retaining device having an end releasably engaged with the adjusting screw and movable between a first free position and a second retained position;

wherein the clearance retaining device is normally in the first free position not engaged with the adjusting screw, and when the clearance retaining device is moved to the second retained position, the adjusting screw is rotated through a pre-determined angle such that the movable jaw is slightly moved away from the fixed jaw for a pre-determined distance, and the clearance retaining device is retained in the second retained position by the adjusting screw.

Preferably, the web area includes a chamber defined therein for receiving the clearance retaining device.

In an embodiment of the invention, the clearance retaining device includes an actuating member having a first section with a first end for releasably engaging with the adjusting screw and a second end. The actuating member further includes a second section having a first end connected to the second end of the first actuating member and a second end securely attached to the web area. A pin is extended through the second end of the first section of the actuating member to allow pivotal movement of the first end of the actuating member relative to the pin. An elastic member is provided for biasing the first end of the first section of the actuating member to the first free position. The elastic member includes a first section securely received in the web area and a second section that extends upwardly for biasing the first end of the first section of the actuating member to the first free position.

In another embodiment of the invention, the clearance retaining device includes an actuating member having a first end for releasably engaging with the adjusting screw and a second end with a slot defined therein. A pin is extended through the slot in the second end of the actuating member to allow pivotal movement of the first end of the actuating member relative to the pin. An elastic element is mounted in the slot of the actuating member for biasing the first end of the actuating member toward the adjusting screw. Furthermore, an elastic member is provided for biasing the first end of the first section of the actuating member to the first free position. The elastic member includes a first section securely received in the web area and a second section that extends upwardly for biasing the first end of the first section of the actuating member to the first free position.

In a further embodiment of the invention, the clearance retaining device includes a supporting member mounted in the web area, an actuating member, an elastic member, and a pin. The actuating member includes a first actuating plate and a second actuating plate. The first actuating plate includes a first section with a slot defined in a distal end thereof and a second section. The second actuating plate includes a first section with a distal end extended through the slot in the first actuating plate and a second section in close contact with the second section of the first actuating plate. The distal end of the first section of the second actuating plate is releasably engaged with the adjusting screw. The elastic member biases the distal end of the second actuating plate to the first free position. The pin is extended through the first section of the first actuating plate, the first section of the second actuating plate, the elastic member, and the supporting plate. This allows the distal end of the first section of the first actuating plate and the distal end of the first section of the second actuating plate to pivot relative to the pin.

In still another embodiment of the invention, the retaining device is an elastic member that includes a first section securely received in the web area and a second section having a first actuating end releasably engaged with the adjusting screw and a second end. A pin is extended through the second end of the second section of the elastic member to allow the first actuating end to pivot relative to the pin.

The adjustable wrenches in accordance with the present invention allow easy, rapid fine adjustment to obtain an optimal clearance for operation, and such fine adjustment can be easily accomplished by a layman. In addition, damage to nuts or the like operated by the adjustable wrench is prevented. Furthermore, the optimal clearance can be repeatedly obtained and reliably retained while allowing easy disengagement of the nuts and the adjustable wrench.

Other objects, advantages, and novel features of the invention will become more apparent from the following detailed description when taken in conjunction with the accompanying drawings.

BRIEF DESCRIPTION OF THD DRAWINGS

DETAILED DESCRIPTION OF THE PREFERRED EMBODIMENTS

Figure 1:
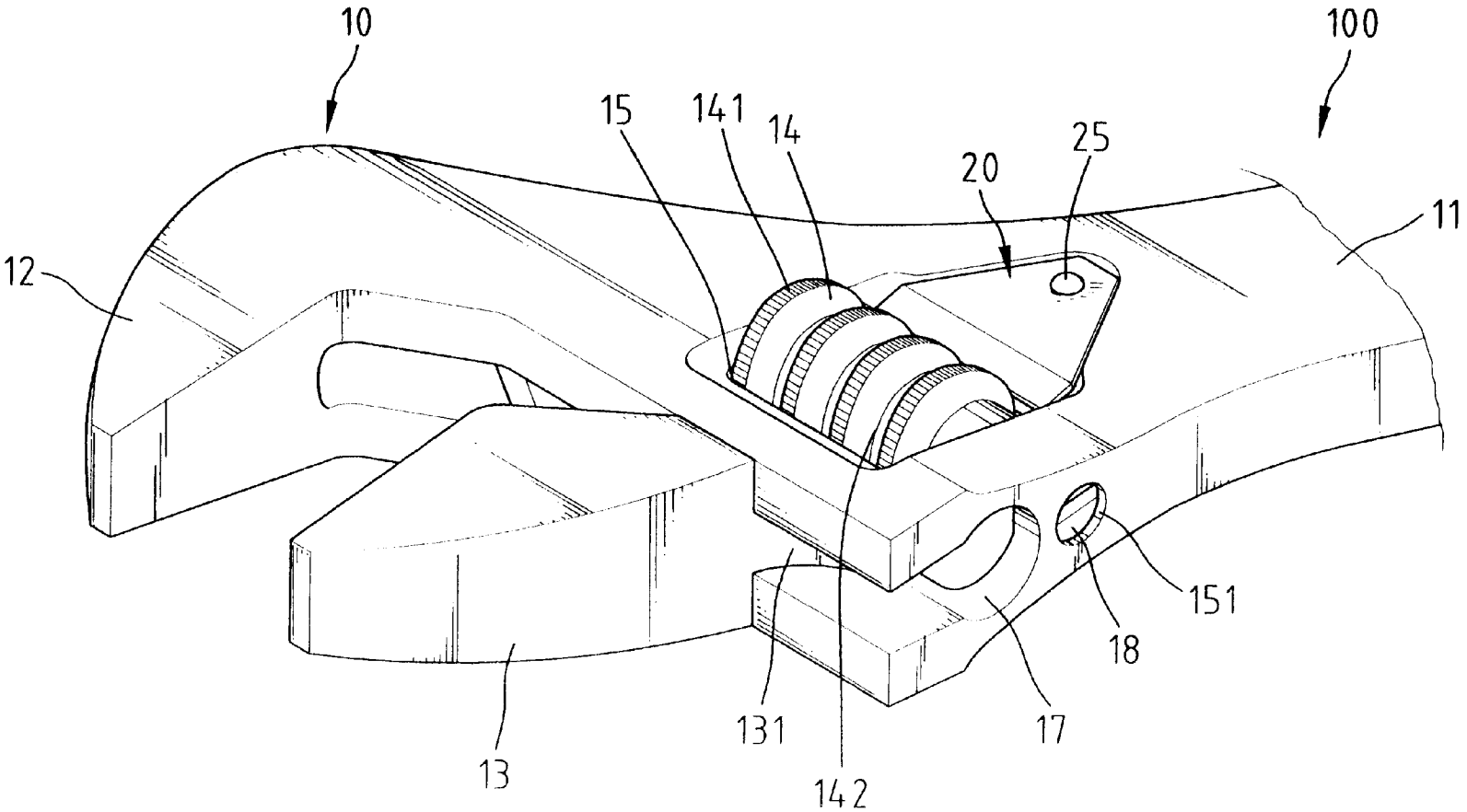
FIG. 1 is a partial perspective view illustrating a head portion of a first embodiment of an adjustable wrench in accordance with the present invention.
Figure 2:
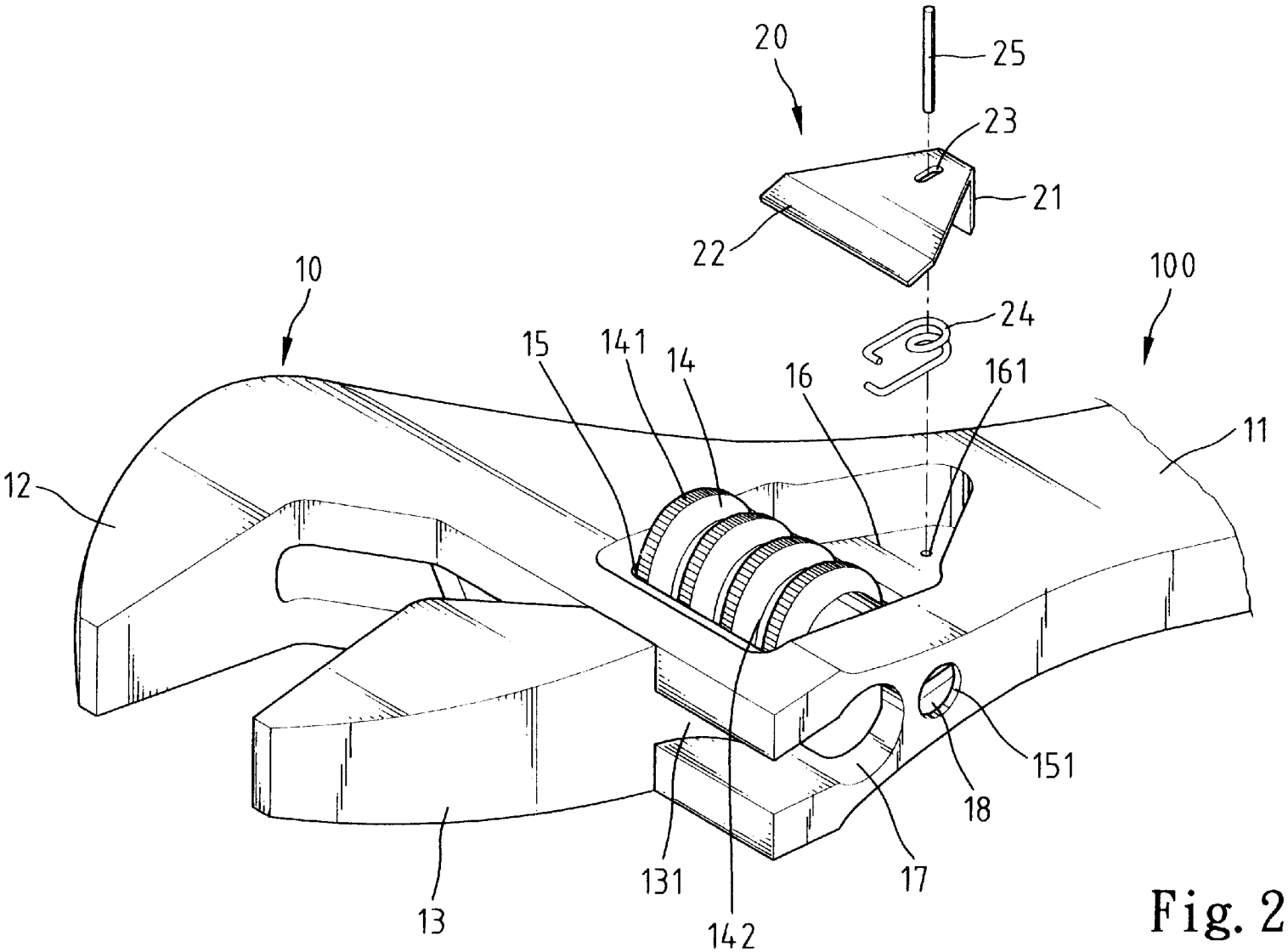
FIG. 2 is a partial exploded view of the adjustable wrench in FIG. 1.
Figure 3:
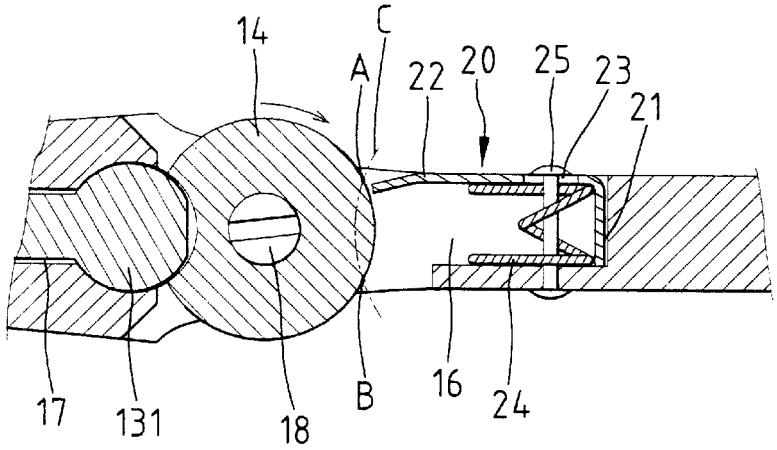
FIGS. 3–5 are partial sectional views illustrating operation of an optimal clearance retaining device of the first embodiment.

Referring to the drawings and initially to FIGS. 1 and 2, a first embodiment of an adjustable wrench 100 in accordance with the present invention generally includes a handle 10 and a head 10. The head 10 includes a fixed jaw 12, a movable jaw 13, and a channel 17 for guiding rectilinear movement of the movable jaw 13 relative to the fixed jaw 12. Interconnected between the handle 11 and the head 10 is a web area (not labeled) that includes a compartment 15 for rotatably receiving an adjusting screw 14. The web area firer includes a chamber 16 communicated with the compartment 15, which will be described later. In this embodiment, the adjusting screw 14 is rotatably mounted to an axle 18 that is securely mounted in a hole 151 that aligns with the compartment 15, thereby allowing the adjusting screw 14 to rotate freely in the compartment 15. The adjusting screw 14 includes a helical groove 142 and an anti-skid surface 141 formed on a peak thereof. Referring to FIG. 3, the movable jaw 13 includes an end 131 received in the helical groove 142, whereby rotational movements of the adjusting screw 14 cause rectilinear movements of the movable jaw 13 relative to the fixed jaw 12, which is conventional and therefore not further described.

Referring to FIGS. 1 to 3, an optimal clearance retaining device is mounted in the chamber 16 and includes a substantially M-shaped elastic member 24, a manual actuating member 20, and a pin 25. The manual actuating member 20 is substantially L-shaped and includes a first actuating section 22 and a second section 21. The pin 25 is extended through a slot 23 in an end of the first actuating section 22, the M-shaped elastic member 24, and a pin hole 161 in a bottom wall that defines the chamber 16, best shown in FIG. 3. Thus, the other end of the first actuating section 22 is pivotable about the pin 25. The elastic member 24 biases the first actuating section 22 to a free position (FIG. 3).

Figure 4:
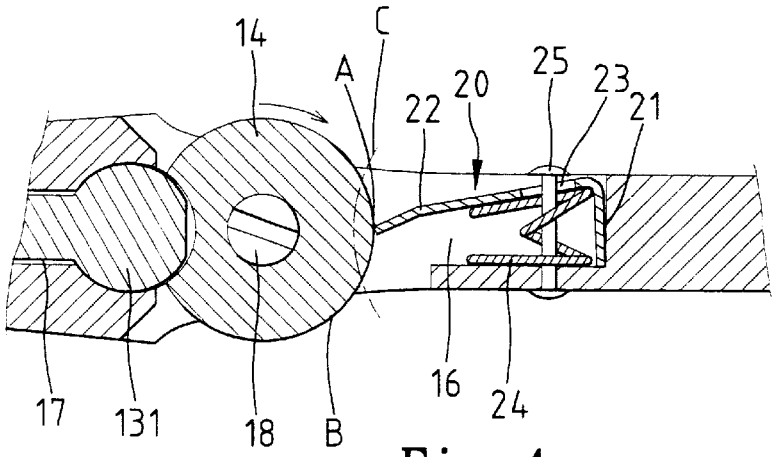
Figure 5:
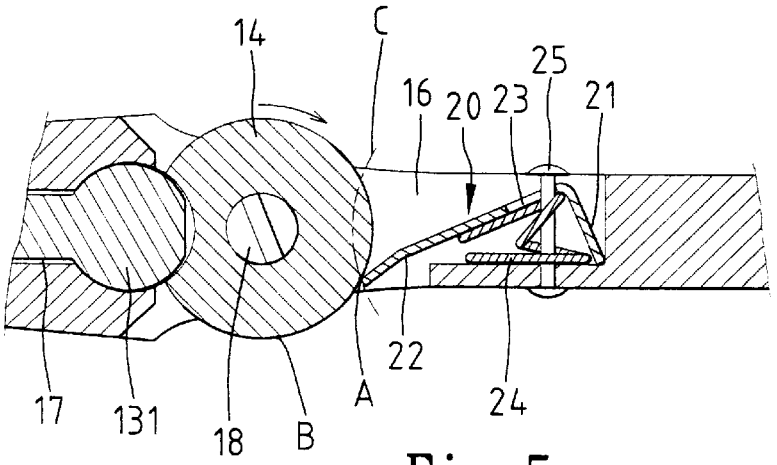
Figure 6:
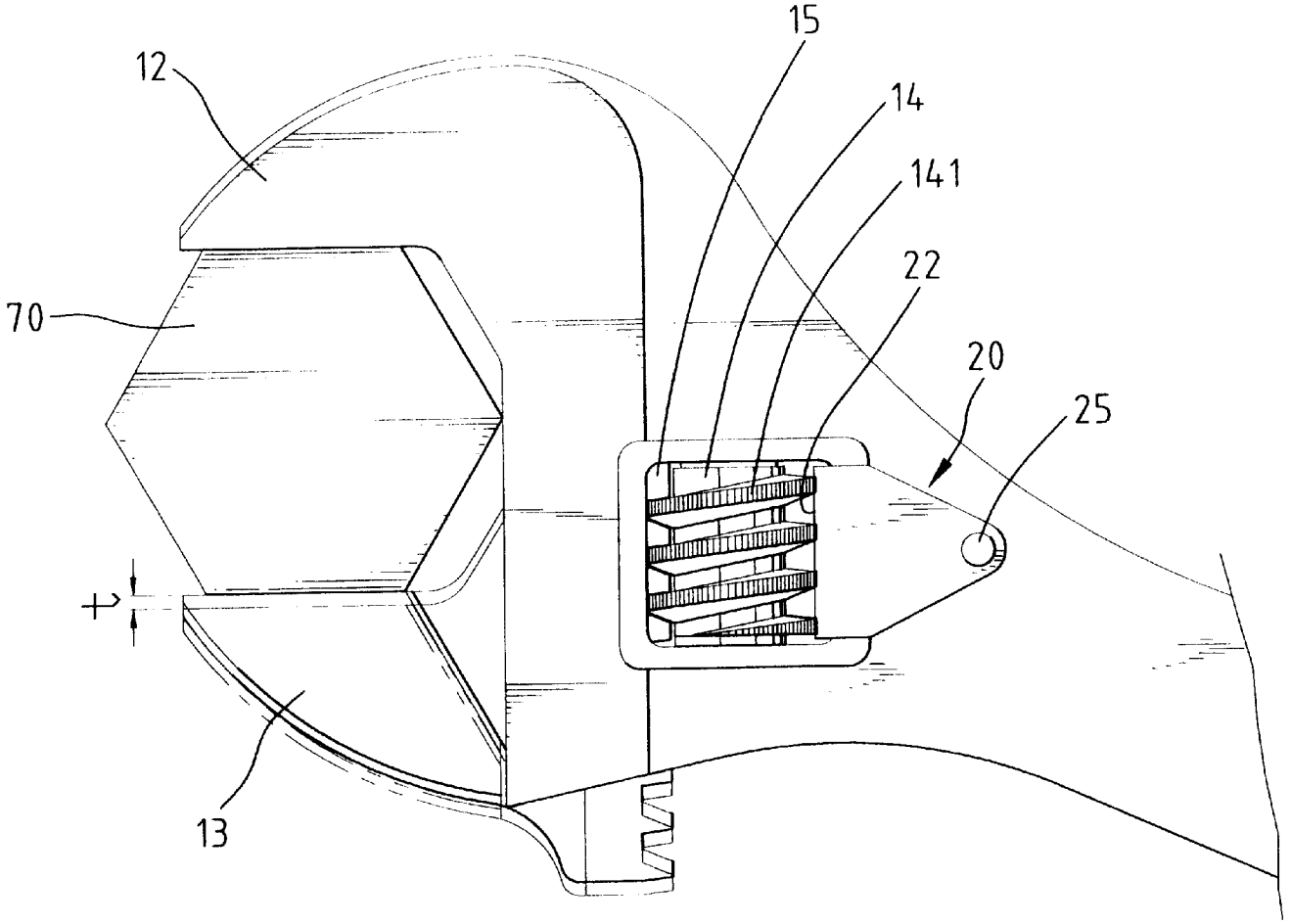
FIG. 6 is a partial top view illustrating use of the adjustable wrench in FIG. 1.
Figure 7:
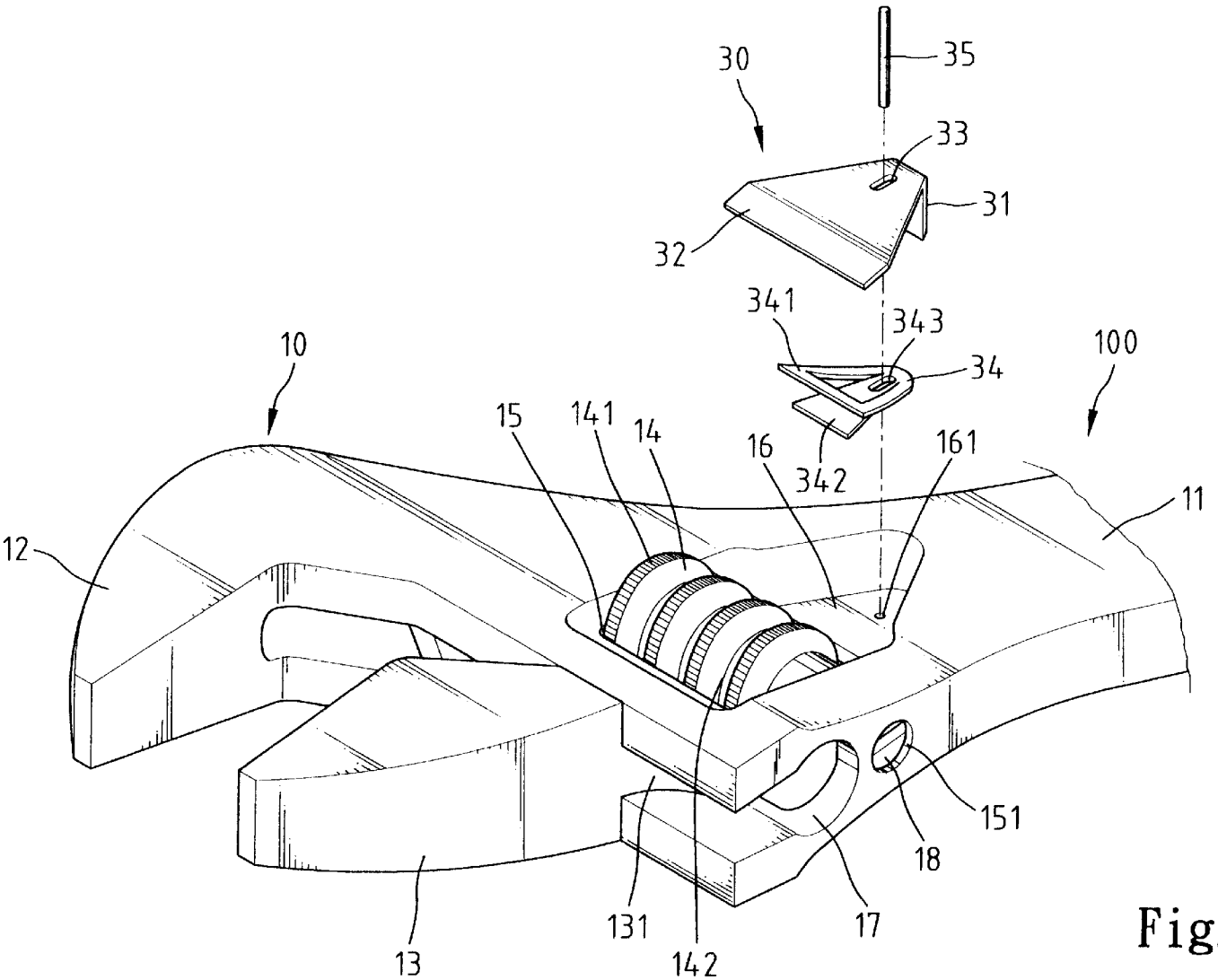
FIG. 7 is a partial exploded view illustrating a head portion of a second embodiment of an adjustable wretch in accordance with the present invention.
Figure 8:
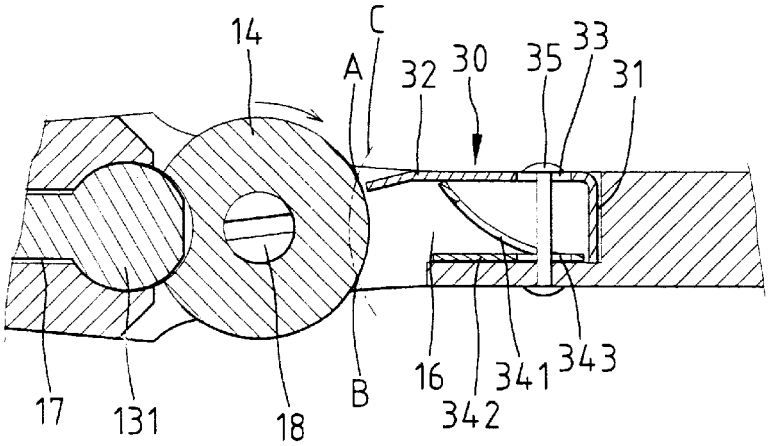
FIGS. 8–10 are partial sectional views illustrating operation of an optimal clearance retaining device of a adjustable wrench of the second embodiment.

In use, the user may clamp a nut 70 (FIG. 6) between the fixed jaw 12 and the movable jaw 13 by means of conventional operational procedure before fine adjustment. If a nut 70 (FIG. 6) has been tightly clamped between the fixed jaw 12 and the movable jaw 13 (see the solid lines in FIG. 6), the user may manually press the other end of the first actuating section 22 that is adjacent to the adjusting screw 14. Thus, upon movement of the first actuating section 22 along a path "C", the first actuating section 22 is moved from a position shown in FIG. 3 to a position shown in FIG. 5, while the status shown in FIG. 4 is a transition status. As a result, the adjusting wheel 14 is moved through a pre-determined angle (see the change of positions of points A and B) such that the movable jaw 13 is slightly moved away from the fixed jaw 12. As a result, the movable jaw 13 has a pre-determined clearance "t" (FIG. 6) to the nut 70. It is appreciated that the second section 21 and the slot 23 assist in stable movement of the manual actuating member 20. The travel of the other end of the first actuating end 22 has been precisely designed to cause desired rotational movement of the adjusting screw 14 to thereby obtain an optimal clearance "t". As shown in FIG. 5, the other end of the first actuating section 22 is retained in place by the adjusting screw 14 after such fine adjustment. The second section 21 has an end that is securely attached to the bottom wall that defines the chamber 16 to assist in retaining of the first actuating section 22. Thus, a reliable optimal clearance can be repeatedly obtained by the adjustable wrench in accordance with the present invention. Such optimal clearance avoids damage to the faces or edges of the nut 70 and allows easy disengagement of the adjustable spanner from the nut 70. In addition, the optimal clearance can be kept during use of the adjustable wrench. After use, the user may rotate the adjusting screw 14 in a reverse direction to release the retaining device to its initial status shown in FIG. 3 under the action of the elastic member 24.

FIGS. 7 to 10 illustrate a second embodiment of the retaining device in accordance with the present invention, wherein like elements are designated by like reference numerals except for the optimal clearance retaining device. In this embodiment, the optimal clearance retaining device includes a substantially ">"-shaped elastic member 34, a manual actuating member 30, and a pin 35. The manual actuating member 30 is substantially L-shaped and includes a first actuating section 32 and a second section 31. The elastic member 34 includes a first section 342 that rests on the bottom wall that defines the chamber 16 and a second section 341 that extends upwardly to bias the first actuating section 32 to a free position. The pin 35 is extended through a slot 33 in an end of the first actuating section 32, a slot 343 in the elastic member 34, and a pin hole 161 in the bottom wall that defines the chamber 16, best shown in FIG. 8.

Thus, the other end of the first actuating section 32 is pivotable about the pin 35.

Figure 9:
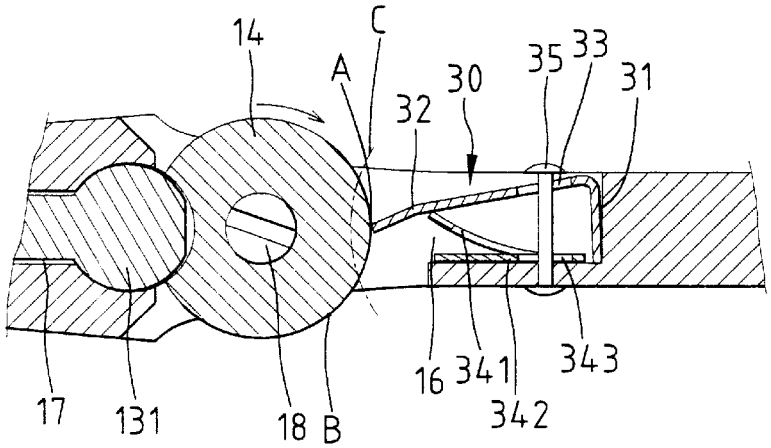
Figure 10:
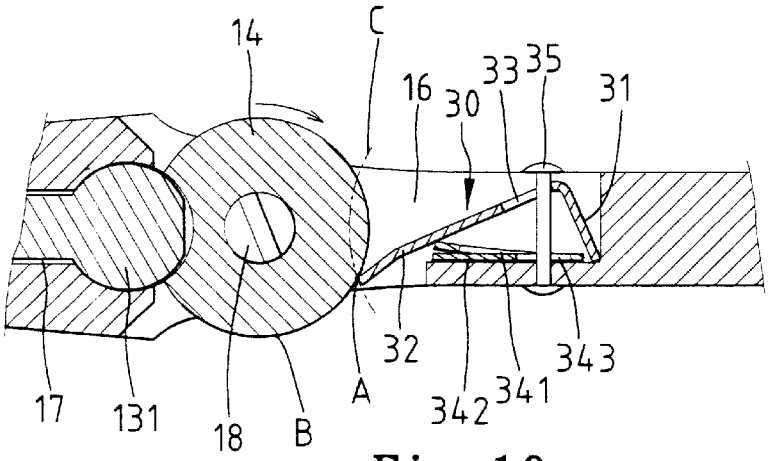
Figure 11:
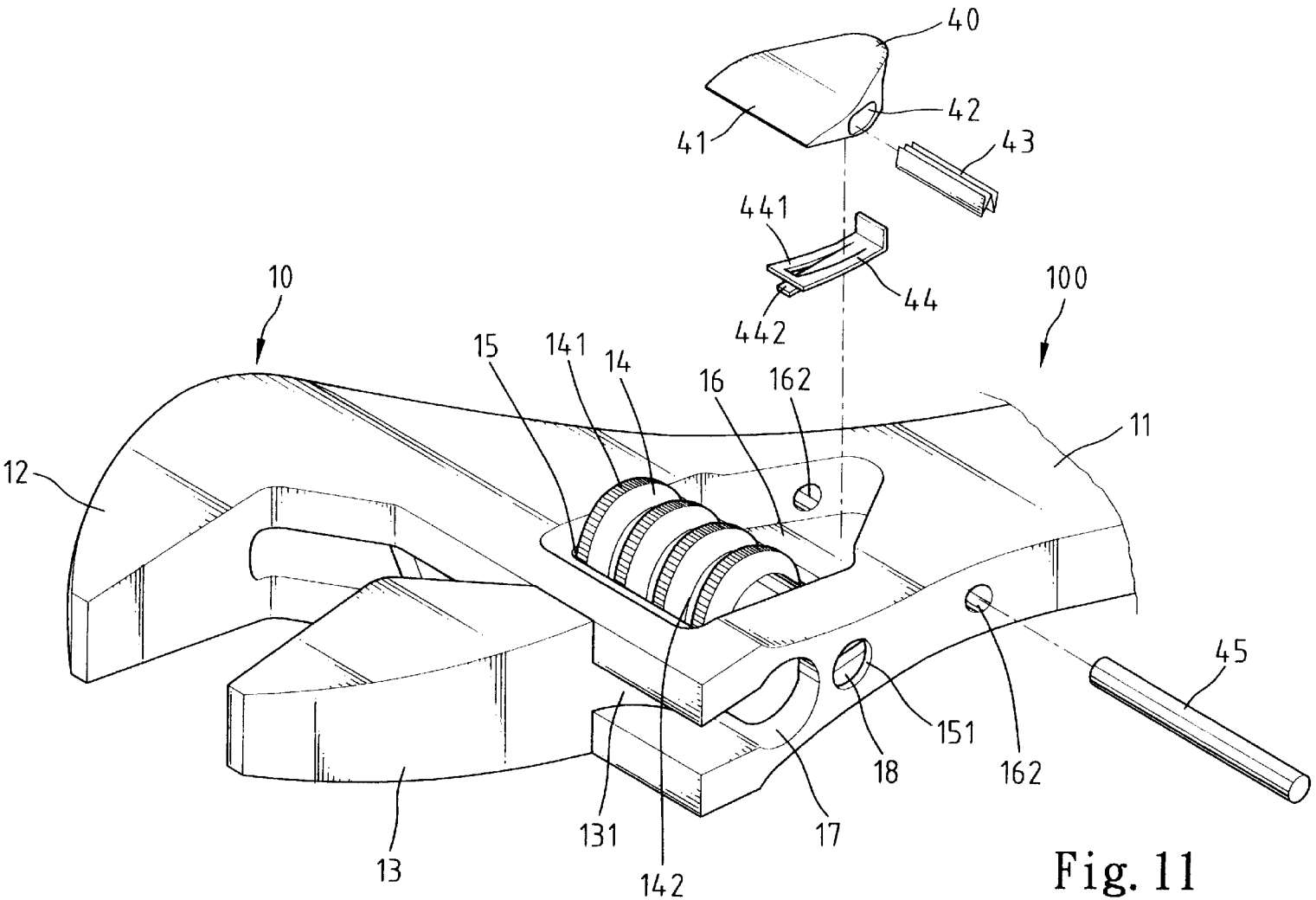
FIG. 11 is a partial exploded view illustrating a head portion of a third embodiment of an adjustable wrench in accordance with the present invention.
Figure 12:
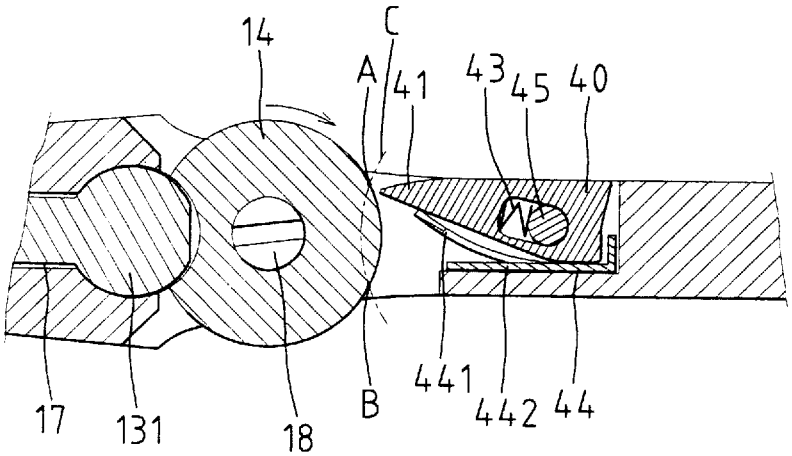
FIGS. 12–14 are partial sectional views illustrating operation of an optimal clearance retaining device of the adjustable wrench of the third embodiment.

Again, if a nut has been tightly clamped between the fixed jaw 12 and the movable jaw 13, the user may manually press the other end of the first actuating section 32 that is adjacent to the adjusting screw. Thus, upon movement of the first actuating section 32 along a path "C", the first actuating section 32 is moved from a position shown in FIG. 8 to a position shown in FIG. 10, while the status shown in FIG. 9 is a transition status. As a result, the adjusting wheel 14 is moved through a pre-determined angle (see the change of positions of points A and B) such that the movable jaw 13 is slightly moved away from the fixed jaw 12. As a result, the movable jaw 13 has a pre-determined clearance to the nut. It is appreciated that the second section 31 and the slot 33 assist in stable movement of the manual actuating member 30. The travel of the first actuating end 32 has been precisely designed to cause desired rotational movement of the adjusting screw 14 to thereby obtain an optimal clearance. As shown in FIG. 10, the first actuating section 32 is retained in place by the adjusting screw 14 after such fine adjustment. Thus, a reliable optimal clearance can be repeatedly obtained by the adjustable wrench in accordance with the present invention. Such optimal clearance avoids damage to the faces or edges of the nut and allows easy disengagement of the adjustable spanner from the nut. In addition, the optimal clearance can be kept during use of the adjustable wrench. After use, the user may rotate the adjusting screw 14 in a reverse direction to release the retaining device to its initial status shown in FIG. 8 under the action of the elastic member 34.

FIGS. 11 to 14 illustrate a third embodiment of the retaining device in accordance with the present invention, wherein like elements are designated by like reference numerals except for the optimal clearance retaining device. In this embodiment, the optimal clearance retaining device includes an elastic member 44, a manual actuating member 40, and a pin 45. The manual actuating member 40 includes a first actuating end 41 and a second end with a slot 42 defined therein. The elastic member 44 includes a first section 442 that rests on the bottom wall that defines the chamber 16 and a second section 441 that extends upwardly to bias the first actuating end 41 to a free position. The pin 45 is extended through a transverse hole 162 defined in the handle 11 and the slot 42. Thus, the first actuating end 41 is pivotable about the pin 45. An elastic element 43 is mounted in the slot 42 and attached between the pin 45 and an inner wall that defines the slot 42 to bias the manual actuating member 40 toward the adjusting screw 14.

Figure 13:
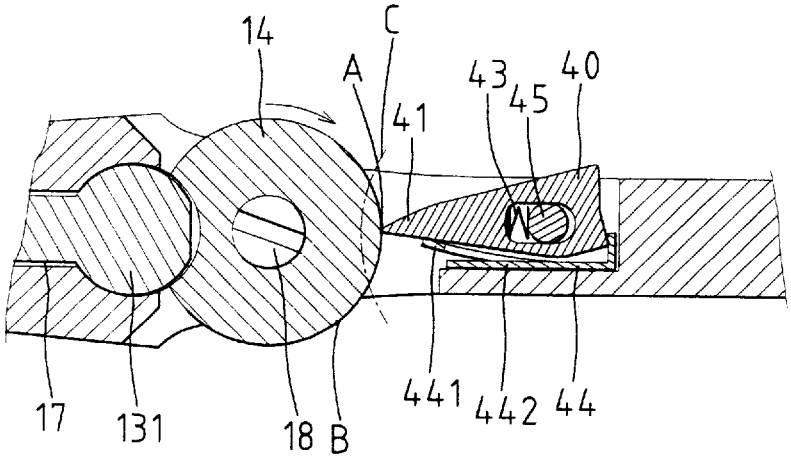
Figure 14:
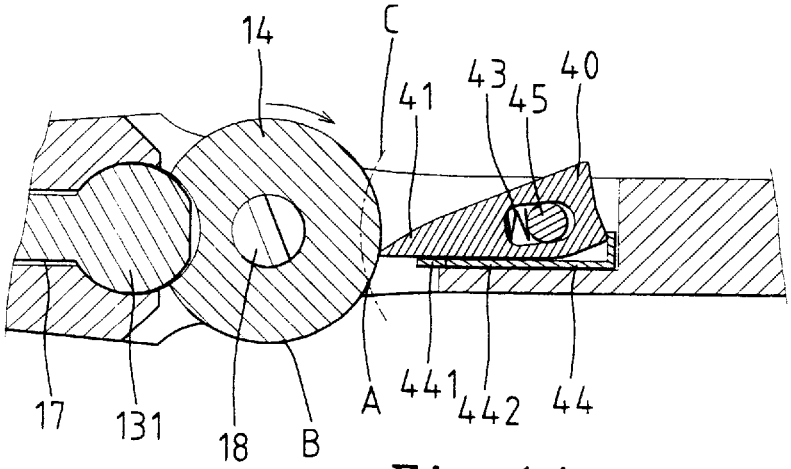
Figure 15:
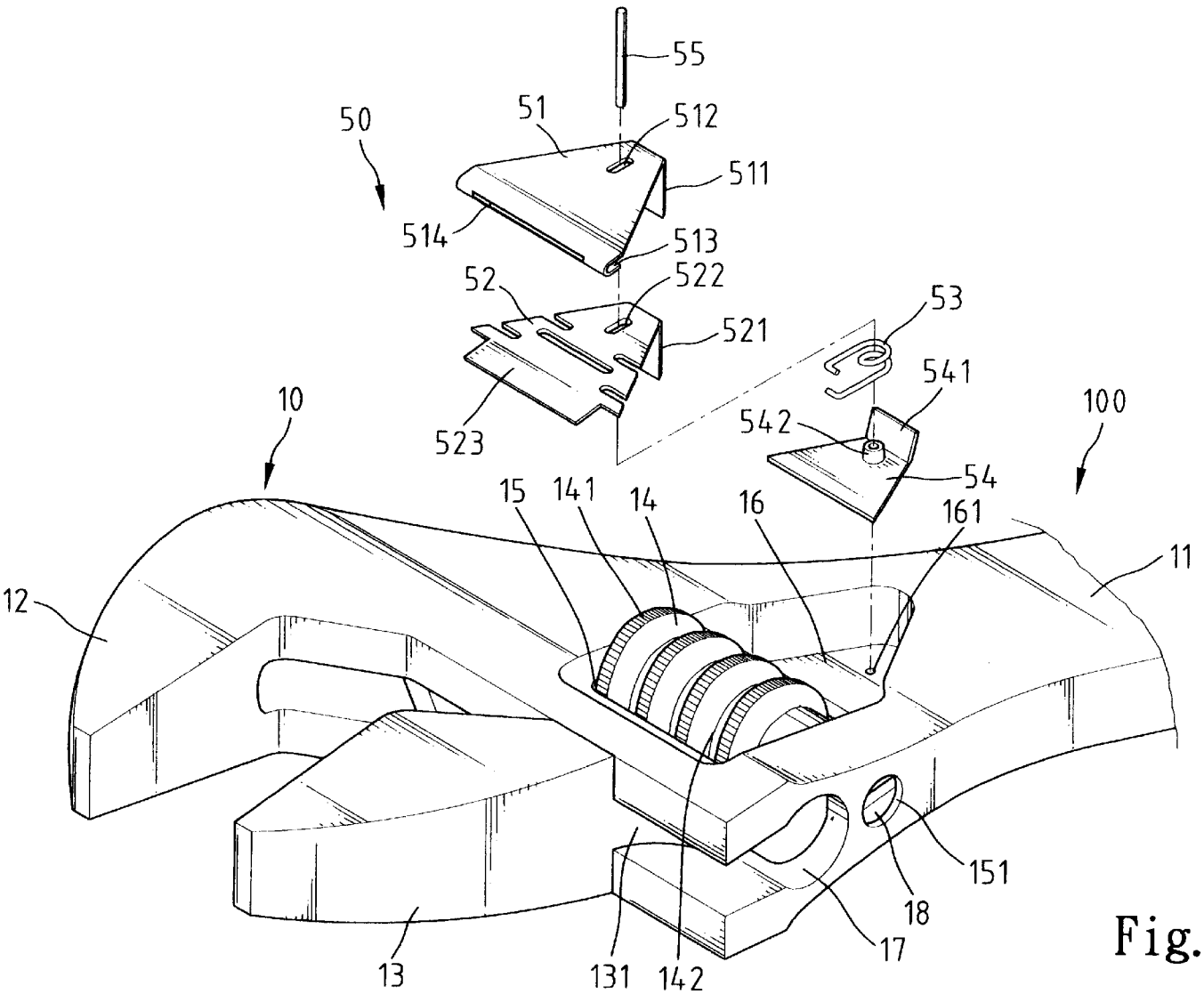
FIG. 15 is a partial exploded view illustrating a head portion of a fourth embodiment of an adjustable wrench in accordance with the present invention.
Figure 16:
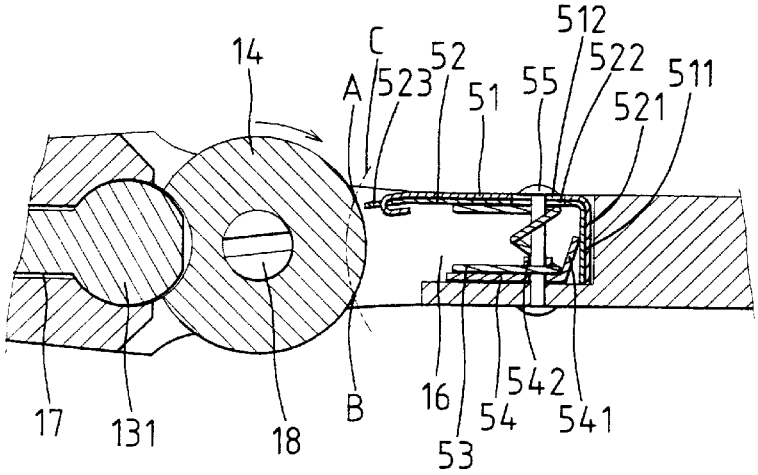
FIGS. 16–18 are partial sectional views illustrating operation of an optimal clearance retaining device of the adjustable wrench of the fourth embodiment.

Again, if a nut has been tightly clamped between the fixed jaw 12 and the movable jaw 13, the user may manually press the other end of the first actuating end 41 that is adjacent to the adjusting screw 14. Thus, upon movement of the first actuating end 41 along a path "C", the first actuating end 41 is moved from a position shown in FIG. 12 to a position shown in FIG. 14, while the status shown in FIG. 13 is a transition status. As a result, the adjusting wheel 14 is moved through a pre-determined angle (see the change of positions of points A and B) such that the movable jaw 13 is slightly moved away from the fixed jaw 12. As a result, the movable jaw 13 has a pre-determined clearance to the nut. The travel of the first actuating end 41 has been precisely designed to cause desired rotational movement of the adjusting screw 14 to thereby obtain an optimal clearance. As shown in FIG. 14, the first actuating end 41 is retained in place by the adjusting screw 14 after such fine adjustment. Thus, a reliable optimal clearance can be repeatedly obtained by the adjustable wrench in accordance with the present invention. Such optimal clearance avoids damage to the faces or edges of the nut and allows easy disengagement of the adjustable spanner from the nut. In addition, the optimal clearance can be kept during use of the adjustable wrench. After use, the user may rotate the adjusting screw 14 in a reverse direction to release the retaining device to its initial status shown in FIG. 12 under the action of the elastic member 44.

FIGS. 15 to 18 illustrate a fourth embodiment of the retaining device in accordance with the present invention, wherein like elements are designated by like reference numerals except for the optimal clearance retaining device. In this embodiment, the optimal clearance retaining device includes an elastic member 53, a manual actuating member 50, a supporting member 54, and a pin 55. The manual actuating member 50 includes a first actuating plate 51 and a second actuating plate 52. The first actuating plate 51 is substantially L-shaped and includes a first section end with a slot 514 defined in a distal hooked end 513 thereof The first actuating plate 51 further includes a second section 511. The second actuating plate 52 is also substantially L-shaped and includes a first section with a distal end 523 extended through the slot 514 of the first actuating plate 51. The second actuating plate 52 further includes a second section 521 that is in close contact with the second section 511 of the first actuating plate 51. The pin 55 is extended through a slot 512 in the first actuating plate 51, a slot 522 in the second actuating plate 52, the elastic member 53, and a holed boss 542 on the supporting plate 54, best shown in FIG. 16. Thus, the distal ends 513 and 523 of the first and second actuating plates 51 and 52 are pivotable about the pin 55. The supporting member 54 includes a vertical wall 541 that retains the second sections 511 and 521.

Figure 17:
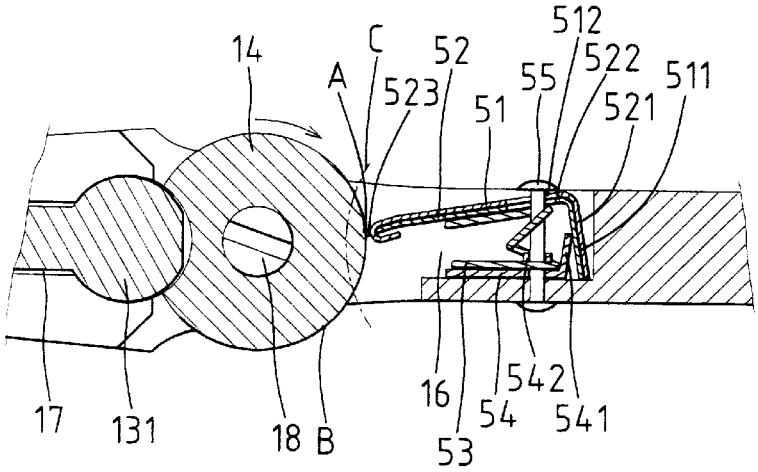
Figure 18:
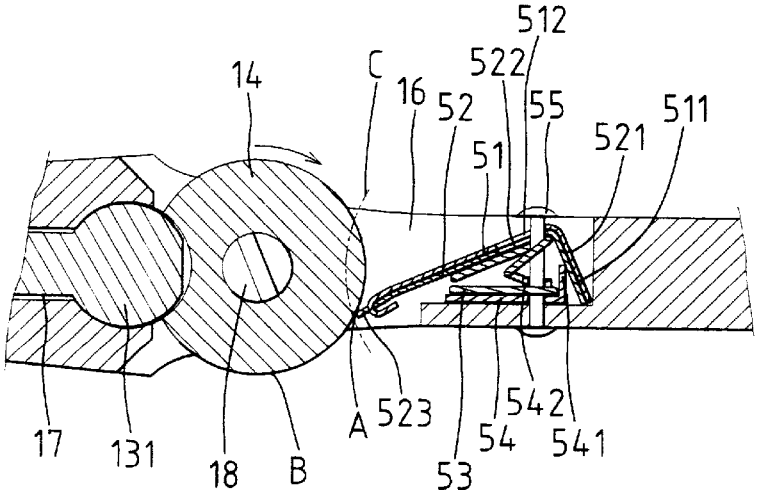
Figure 19:
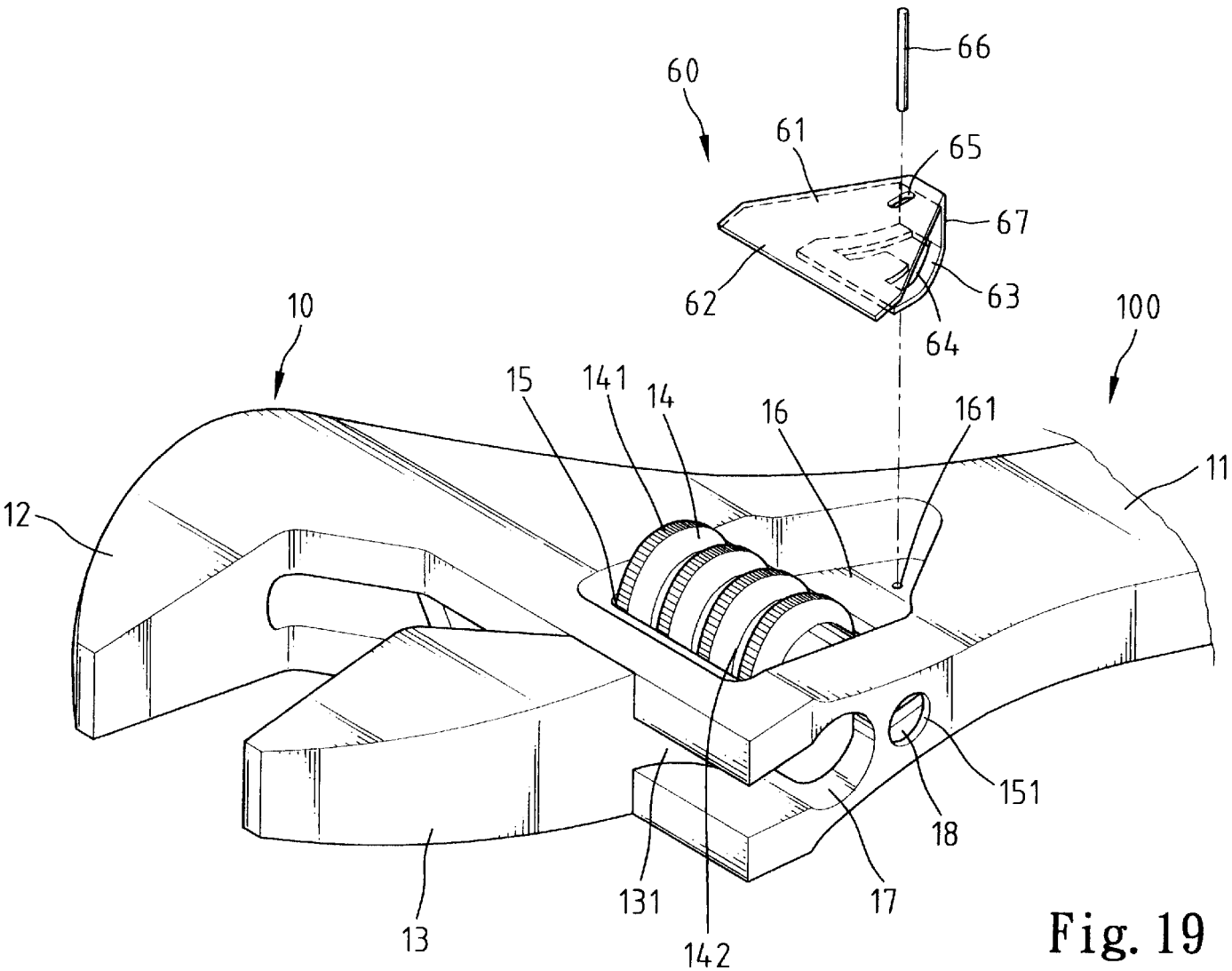
FIG. 19 is a partial exploded view illustrating a head portion of a fifth embodiment of an adjustable wrench in accordance with the present invention.
Figure 20:
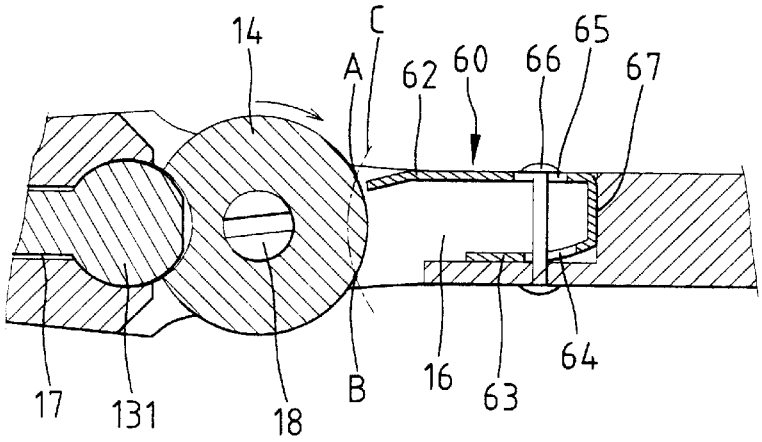
FIGS. 20–22 are partial sectional views illustrating operation of an optimal clearance retaining device of the adjustable wrench of the fifth embodiment.

Again, if a nut has been tightly clamped between the fixed jaw 12 and the movable jaw 13, the user may manually press the other end of the first actuating end 41 that is adjacent to the adjusting screw 14. Thus, upon movement of the first actuating plate 51 along a path "C", the distal end 523 of the second actuating plate 52 is moved from a position shown in FIG. 16 to a position shown in FIG. 18, while the status shown in FIG. 17 is a transition status. As a result, the adjusting wheel 14 is moved through a pre-determined angle (see the change of positions of points A and B) such that the movable jaw 13 is moved away from the fixed jaw 12. As a result, the movable jaw 13 has a pre-determined clearance to the nut. The travel of the distal end 523 of the second actuating plate 52 has been precisely designed to cause desired rotational movement of the adjusting screw 14 to thereby obtain an optimal clearance. As shown in FIG. 18, the distal end 523 of the second actuating plate 52 is retained in place by the adjusting screw 14 after such fine adjustment. Thus, a reliable optimal clearance can be repeatedly obtained by the adjustable wrench in accordance with the present invention. Such optimal clearance avoids damage to the faces or edges of the nut and allows easy disengagement of the adjustable spanner from the nut. In addition, the optimal clearance can be kept during use of the adjustable wrench. After use, the user may rotate the adjusting screw 14 in a reverse direction to release the retaining device to its initial status shown in FIG. 16 under the action of the elastic member 53.

FIGS. 19 to 22 illustrate a fifth embodiment of the retaining device in accordance with the present invention, wherein like elements are designated by like reference numerals except for the optimal clearance retaining device. In this embodiment, the optimal clearance retaining device includes an elastic member 60 and a pin 66. The elastic member 60 includes a first actuating section 61, a second section 63 that rests on the bottom wall which defines the chamber 16, and a connecting section 67 interconnecting the first section 61 and the second section 63. The first actuating section 61 includes a first actuating end 62 and a second end with a slot 42 defined therein. The pin 66 is extended through the slot 65 in the first actuating section 61, a slot 64 in the second section, and a hole 161 in the bottom wall that defines the chamber 16. Thus, the first actuating end 62 is pivotable about the pin 66.

Figure 21:
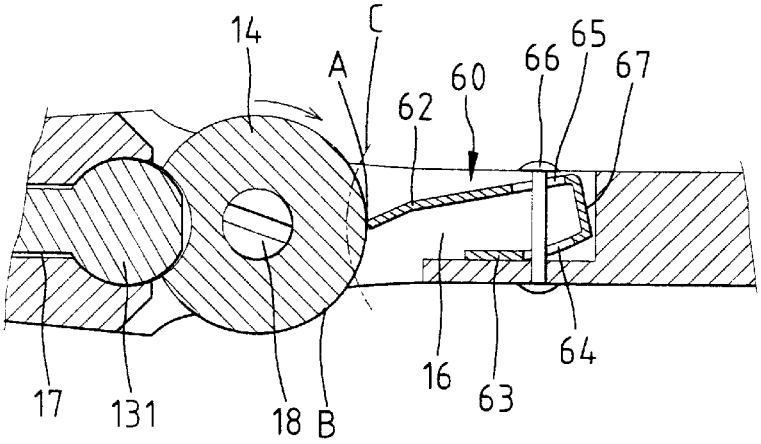
Figure 22:
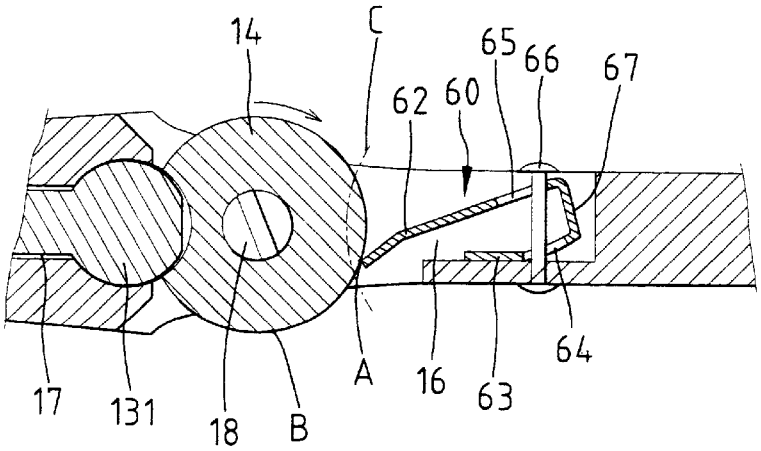
Figure 23:
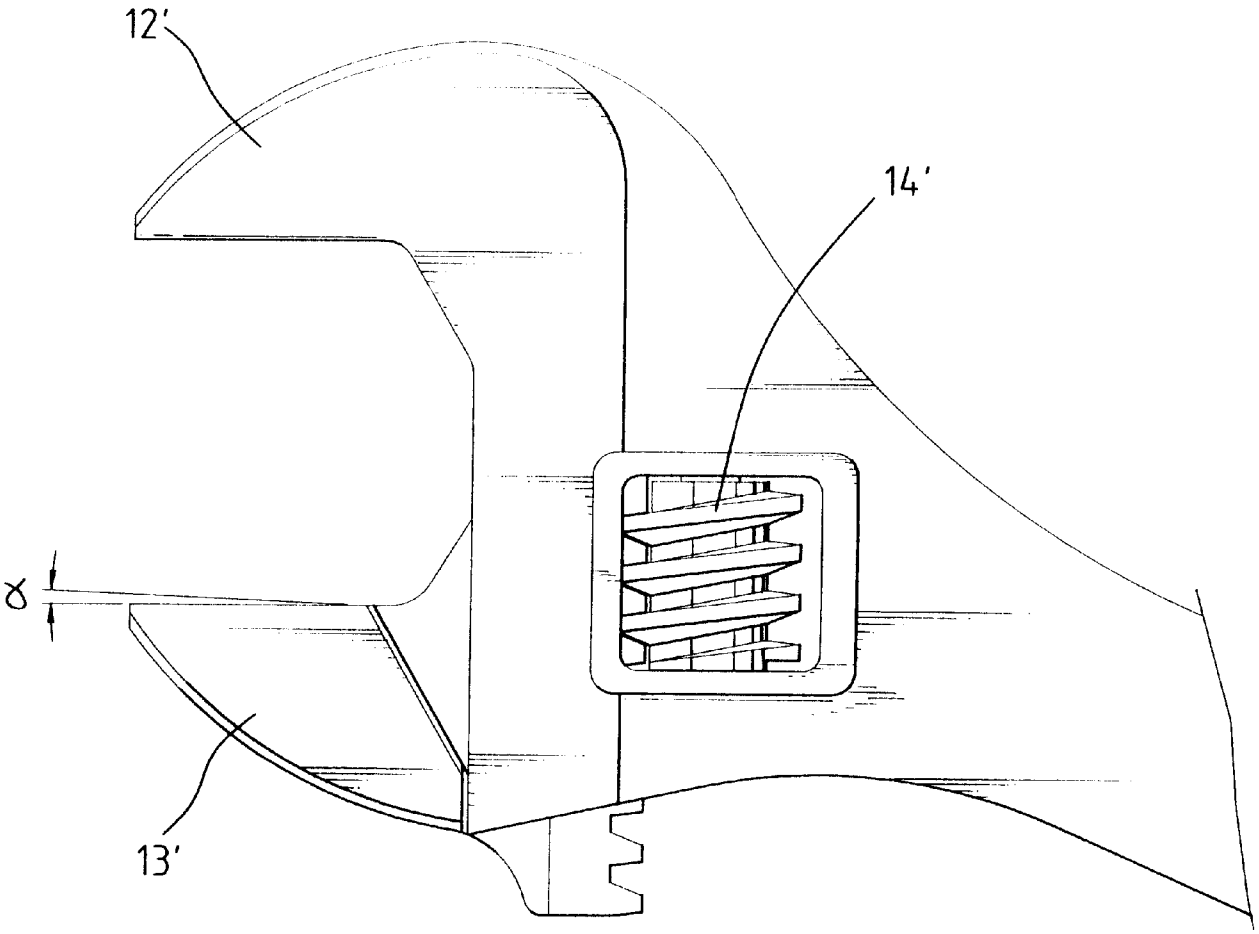
Fig. 23 PRIOR ART
FIG. 23 is a schematic top view of a conventional adjustable wrench.

Again, if a nut has been tightly clamped between the fixed jaw 12 and the movable jaw 13, the user may manually press the first actuating end 62 that is adjacent to the adjusting screw 14. Thus, upon movement of the first actuating end 62 along a path "C", the first actuating end 62 is moved from a position shown in FIG. 20 to a position shown in FIG. 22, while the status shown in FIG. 21 is a transition status. As a result, the adjusting wheel 14 is moved through a pre-determined angle (see the change of positions of points A and B) such that the movable jaw 13 is slightly moved away from the fixed jaw 12. As a result, the movable jaw 13 has a pre-determined clearance to the nut. The travel of the first actuating end 62 has been precisely designed to cause desired rotational movement of the adjusting screw 14 to thereby obtain an optimal clearance. As shown in FIG. 22, the first actuating end 62 is retained in place by the adjusting screw 14 after such fine adjustment. Thus, a reliable optimal clearance can be repeatedly obtained by the adjustable wrench in accordance with the present invention. Such optimal clearance avoids damage to the faces or edges of the nut and allows easy disengagement of the adjustable spanner from the nut. In addition, the optimal clearance can be kept during use of the adjustable wrench. After use, the user may rotate the adjusting screw 14 in a reverse direction to release the retaining device to its initial status shown in FIG. 22 under the action of the elastic member 60.

It is appreciated that each of the actuating ends of the optimal clearance retaining devices in all embodiments is retained in a free position that does not engage with the adjusting screw 14 to prevent from interfering with operation of the adjusting wheel 14 before fine adjustment.

According to the above description, it is appreciated that the adjustable wrenches in accordance with the present invention allow easy, rapid fine adjustment to obtain an optimal clearance for operation, and such fine adjustment can be easily accomplished by a layman. In addition, damage to nuts or the like operated by the adjustable wrench is prevented. Furthermore, the optimal clearance can be repeatedly obtained and reliably retained while allowing easy disengagement of the nuts and the adjustable wrench.

Although the invention has been explained in relation to its preferred embodiment, it is to be understood that many other possible modifications and variations can be made without departing from the spirit and scope of the invention as hereinafter claimed.

What is claimed is:

1. An adjustable wrench comprising:

a handle;

a head connected to the handle and including a fixed jaw formed thereon and a movable jaw mounted thereon;

an adjusting screw rotatably mounted in a web area between the handle and the head for moving the movable jaw relative to the fixed jaw upon rotational movement of the adjusting screw;

a clearance retaining device mounted in the web area having an end releasably engaged with the adjusting screw and movable between a first free position and a second retained position, with the end of said clearance retaining device engaging said adjusting screw when in the second retained position, and with engagement of said end of the clearance retaining device causing rotation of said adjusting screw; and wherein the clearance retaining device is normally in the first free position not engaged with the adjusting screw, and when the clearance retaining device is moved to the second retained position, the adjusting screw is rotated through a pre-determined angle such that the movable jaw is slightly moved away from the fixed jaw for a pre-determined distance, and the clearance retaining device is retained in the second retained position by the adjusting screw.

2. The adjustable wrench as claimed in claim 1, wherein the web area includes a chamber defined therein for receiving the clearance retaining device.

3. The adjustable wrench as claimed in claim 1, wherein the clearance retaining device includes an actuating member having a first section with a first end for releasably engaging with the adjusting screw and a second end, the actuating member further including a second section having a first end connected to the second end of the first actuating member and a second end securely attached to the web area.

4. The adjustable wrench as claimed in claim 3, further comprising a pin extended through the second end of the first section of the actuating member to allow pivotal movement of the first end of the actuating member relative to the pin.

5. The adjustable wrench as claimed in claim 3, further comprising an elastic member for biasing the first end of the first section of the actuating member to the first free position.

6. The adjustable wrench as claimed in claim 5, wherein the elastic member includes a first section securely received in the web area and a second section that extends upwardly for biasing the first end of the first section of the actuating member to the first free position.

7. The adjustable wrench as claimed in claim 1, wherein the clearance retaining device includes an actuating member having a first end for releasably engaging with the adjusting screw and a second end with a slot defined therein, and a pin being extended through the slot in the second end of the actuating member to allow pivotal movement of the first end of the actuating member relative to the pin.

8. The adjustable wrench as claimed in claim 7, further comprising an elastic element mounted in the slot of the actuating member for biasing the first end of the actuating member toward the adjusting screw.

9. The adjustable wrench as claimed in claim 7, further comprising an elastic member for biasing the first end of the first section of the actuating member to the first free position.

10. The adjustable wrench as claimed in claim 9, wherein the elastic member includes a first section securely received in the web area and a second section that extends upwardly for biasing the first end of the first section of the actuating member to the first free position.

11. The adjustable wrench as claimed in claim 1, wherein the clearance retaining device includes a supporting member mounted in the web area, an actuating member, an elastic member, and a pin, the actuating member including a first actuating plate and a second actuating plate, the first actuating plate including a first section with a slot defined in a distal end thereof and a second section, the second actuating plate including a first section with a distal end extended through the slot in the first actuating plate and a second section in close contact with the second section of the first actuating plate, the distal end of the first section of the second actuating plate being releasably engaged with the adjusting screw, the elastic member biasing the distal end of the second actuating plate to the first free position, the pin being extended through the first section of the first actuating plate, the first section of the second actuating plate, the elastic member, and the supporting plate, thereby allowing the distal end of the first section of the first actuating plate and the distal end of the first section of the second actuating plate to pivot relative to the pin.

12. The adjustable wrench as claimed in claim 1, wherein the clearance retaining device is an elastic member that includes a first section securely received in the web area and a second section having a first actuating end releasably engaged with the adjusting screw and a second end, and further comprising a pin extended through the second end of the second section of the elastic member to allow the first actuating end to pivot relative to the pin.

* * * * *